US010948245B2

(12) United States Patent
Gotterbarm et al.

(10) Patent No.: US 10,948,245 B2
(45) Date of Patent: Mar. 16, 2021

(54) HEAT EXCHANGER TUBE

(71) Applicant: WIELAND-WERKE AG, Ulm (DE)

(72) Inventors: Achim Gotterbarm, Dornstadt (DE); Ronald Lutz, Blaubeuren (DE); Jean El Hajal, Ulm (DE); Manfred Knab, Dornstadt (DE)

(73) Assignee: WIELAND-WERKE AG, Ulm (DE)

( * ) Notice: Subject to any disclaimer, the term of this patent is extended or adjusted under 35 U.S.C. 154(b) by 132 days.

(21) Appl. No.: 16/099,271

(22) PCT Filed: May 17, 2017

(86) PCT No.: PCT/EP2017/000597
§ 371 (c)(1),
(2) Date: Nov. 6, 2018

(87) PCT Pub. No.: WO2017/207091
PCT Pub. Date: Dec. 7, 2017

(65) Prior Publication Data

US 2019/0145718 A1 May 16, 2019

(30) Foreign Application Priority Data

Jun. 1, 2016 (DE) ..... 10 2016 006 913.9

(51) Int. Cl.
*F28F 1/14* (2006.01)
*F28F 1/36* (2006.01)
(Continued)

(52) U.S. Cl.
CPC ..... *F28F 1/36* (2013.01); *F28F 1/18* (2013.01); *F28F 1/40* (2013.01); *F28F 1/422* (2013.01)

(58) Field of Classification Search
CPC ..... F28F 1/36; F28F 1/18; F28F 1/40; F28F 1/422
(Continued)

(56) References Cited

U.S. PATENT DOCUMENTS 3,696,861 A 10/1972 Webb
3,776,018 A 12/1973 French
(Continued)

FOREIGN PATENT DOCUMENTS

DE 27 58 526 C2 7/1979
DE 101 56 374 C1 2/2003
(Continued)

OTHER PUBLICATIONS

International Search Report issued in Application No. PCT/EP2017/000597 with English translation dated Aug. 16, 2017 (5 pages).
(Continued)

*Primary Examiner* — Claire E Rojohn, III
(74) *Attorney, Agent, or Firm* — Flynn Thiel, P.C.

(57) ABSTRACT

The invention relates to a heat exchanger tube (1) having a tube longitudinal axis (A), a tube wall (2), an outer tube face (21) and an inner tube face (22), wherein axially parallel or helically circumferential continuous fins (3) are formed on the outer tube face (21) and/or inner tube face (22) which fins continuously run from the tube wall, and continuously extending primary grooves (4) are formed between respectively adjacent fins (3). According to the invention, the fins (3) along the fin profile are subdivided into periodically repeating fin sections (31) which are divided into a multiplicity of projections (6) with a projection height (h), wherein the projections (6) are formed between primary grooves (4) by making cuts into the fins (3) at a cutting depth
(Continued)

transversely with respect to the fin profile to form fin segments and by raising the fin segments in a main orientation along the fin profile.

20 Claims, 4 Drawing Sheets

(51) Int. Cl.
*F28F 1/40* (2006.01)
*F28F 1/42* (2006.01)
*F28F 1/18* (2006.01)

(58) Field of Classification Search
USPC ..... 165/183
See application file for complete search history.

(56) References Cited

U.S. PATENT DOCUMENTS 4,179,911 A 12/1979 Saier et al.
4,216,826 A 8/1980 Fujikake
4,577,381 A 3/1986 Sato et al.
4,660,630 A 4/1987 Cunningham et al.
4,733,698 A * 3/1988 Sato ..... F28F 1/40 138/38
5,054,548 A 10/1991 Zohler
5,332,034 A * 7/1994 Chiang ..... F28F 1/40 165/184
5,458,191 A * 10/1995 Chiang ..... F28F 1/40 165/133
5,775,411 A 7/1998 Schuez et al.
5,975,196 A * 11/1999 Gaffaney ..... F28F 1/40 165/133
6,182,743 B1 * 2/2001 Bennett ..... F28F 1/40 165/133
6,336,501 B1 * 1/2002 Ishikawa ..... F28F 1/40 165/133
6,488,078 B2 * 12/2002 Beutler ..... B21C 37/207 165/133
7,311,137 B2 * 12/2007 Thors ..... F28F 1/422 165/133
7,451,542 B2 11/2008 Brand et al.
8,857,505 B2 10/2014 Beutler et al.
9,188,287 B2 * 11/2015 Krautschick ..... F15D 1/004
9,234,709 B2 * 1/2016 Gotterbarm ..... B23P 15/26
2002/0070011 A1 * 6/2002 Itoh ..... F28F 1/40 165/133
2002/0195233 A1 * 12/2002 Thors ..... F28F 1/40 165/133
2005/0145377 A1 7/2005 Thors et al.
2006/0112535 A1 * 6/2006 Thors ..... B21J 5/068 29/557
2006/0213346 A1 * 9/2006 Thors ..... B21C 37/158 83/178
2007/0124909 A1 * 6/2007 Thors ..... B21C 37/207 29/428
2007/0234871 A1 * 10/2007 Thors ..... F28F 1/422 83/875
2009/0178432 A1 * 7/2009 Reagen ..... F25B 39/02 62/347
2010/0193170 A1 * 8/2010 Beutler ..... B21C 37/207 165/181
2010/0193171 A1 * 8/2010 Beppu ..... C21D 8/08 165/181
2011/0036553 A1 * 2/2011 Christen ..... F28F 19/006 165/185
2016/0097604 A1 * 4/2016 Reagen ..... F28F 21/084 165/183
2016/0369377 A1 * 12/2016 Somani ..... C22C 21/00

FOREIGN PATENT DOCUMENTS

DE 10 2006 008 083 B4 9/2007
DE 603 17 506 T2 9/2008
EP 0 713 072 B1 5/1996
WO WO 03/104736 A1 12/2003

OTHER PUBLICATIONS

Written Opinion of International Searching Authority issued in Application No. PCT/EP2017/000597 dated Aug. 16, 2017 (5 pages).
Office Action of German Patent Office issued in German Application No. 10 2016 006 913.9 dated Feb. 8, 2017 (5 pages).

* cited by examiner

31

31

HEAT EXCHANGER TUBE

TECHNICAL FIELD

The present invention relates to a heat exchanger tube having a tube wall, an outer tube face, an inner tube face, axially parallel or helically circumferential continuous fins formed on the outer tube face and/or the inner tube face which fins continuously run from the tube wall, and continuously extending primary grooves formed between respectively adjacent fins.

BACKGROUND AND SUMMARY

Heat exchange occurs in many fields of refrigeration and air-conditioning technology as well as in processing and energy technology. In these fields, tubular bundle heat exchangers are frequently used to exchange heat. In many applications, a liquid, which is cooled or heated as a function of the direction of the heat flow, flows on the inner tube face here. The heat is output to the medium located on the outer tube face or extracted therefrom.

It is generally known that, instead of smooth tubes, structured tubes are used in tubular bundle heat exchangers. The transfer of heat is improved by the structures. The heat flux density is increased by this and the heat exchanger can be constructed more compactly. Alternatively, the heat flux density can be retained and the driving temperature difference can be lowered, as a result of which heat transfer which is more efficient in terms of energy is possible.

Heat exchanger tubes which are structured on one face or both faces for tubular bundle heat exchangers usually have at least one structured region and smooth end pieces and possibly smooth intermediate pieces. The smooth end pieces or intermediate pieces bound the structured regions. So that the tube can be easily installed in the tubular bundle heat exchanger, the outer diameter of the structured regions should not be larger than the outer diameter of the smooth end pieces and intermediate pieces.

Integrally rolled finned tubes are frequently used as structured heat exchanger tubes. Integrally rolled finned tubes are understood to be finned tubes in which the fins have been formed from the material of the wall of a smooth tube. In many cases, finned tubes have a multiplicity of axially parallel or helically circumferential continuous fins on the inner tube face which make the inner surface larger and improve the transfer of heat coefficient on the inner tube face. On the outer face thereof, the finned tubes have fins which run around in an annular or helical shape.

In the past, depending on the application, many possible ways were developed of increasing further the transfer of heat on the outer face of integrally rolled finned tubes by providing the fins with further structure features on the outer tube face. As is known, for example, from U.S. Pat. No. 5,775,411, when condensation of refrigerants occurs on the outer tube face, the transfer of heat coefficient is significantly increased if the fin sides are provided with additional convex sides. When refrigerants on the outer tube face evaporate, it has found to improve the efficiency to partially close the ducts located between the fins, with the result that cavities are produced which are connected to the surroundings by pores or slits. As is already known from numerous documents, such essentially closed ducts are produced by bending over or folding over the fin (U.S. Pat. Nos. 3,696,861, 5,054,548), by splitting and compressing the fin (DE 2 758 526 C2, U.S. Pat. No. 4,577,381) and by notching and compressing the fin (U.S. Pat. No. 4,660,630, EP 0 713 072 B1, U.S. Pat. No. 4,216,826).

The performance improvements mentioned above on the outer tube face result in the main part of the entire transfer of heat resistance being moved to the inner tube face. This effect occurs, in particular, at low flow rates on the inner tube face, such as for example during partial load operation. In order to reduce the entire transfer of heat resistance significantly, it is necessary to increase further the transfer of heat coefficient on the inner tube face.

In order to increase the transfer of heat of the inner tube face, the axially parallel or helically circumferential continuous inner fins can be provided with grooves, as described in documents DE 101 56 374 C1 and DE 10 2006 008 083 B4. It is significant here that as a result of the use of profiled rolling mandrels which are disclosed here for generating the inner fins and grooves the dimensions of the inner structure and the outer structure of the finned tube can be set independently of one another. As a result, the structures on the outer and inner face can be adapted to the respective requirements and the tube can be shaped accordingly.

Against this background, the object of the present invention is to develop inner structures and outer structures of heat exchanger tubes of the above-mentioned type in such a way that a further increase in performance is achieved compared to already known tubes.

The invention includes a heat exchanger tube having a tube longitudinal axis, a tube wall, an outer tube face and an inner tube face, wherein axially parallel or helically circumferential continuous fins are formed on the outer tube face and/or inner tube face which fins continuously run from the tube wall, and continuously extending primary grooves are formed between respectively adjacent fins. According to the invention, the fins are subdivided along the fin profile into periodically repeating fin sections which are divided into a multiplicity of projections with a projection height, wherein the projections formed between primary grooves by making cuts into the fins at a cutting depth transversely with respect to the fin profile to form fin segments and by raising the fin segments in a main orientation along the fin profile.

The structured region can in principle be formed here on the outer tube face or the inner tube face. However, it is preferred to arrange the fin sections according to the invention in the interior of the tube. The described structures can be used both for evaporator tubes and for condenser tubes.

The projection height is expediently defined as the dimension of a projection in the radial direction. The projection height is then the distance starting from the tube wall as far as the point of the projection which is farthest away from the tube wall in the radial direction.

The cutting depth, also referred to as notch depth, is the distance measured in the radial direction starting from the original fin tip as far as the deepest point of the notch. In other words: The notch depth is the difference between the original fin height and the residual fin height remaining at the deepest point of a notch.

The invention is based here on the idea that the fin sections can in principle be formed on the outer tube face or the inner tube face. However, it is preferred to arrange the fin sections according to the invention in the interior of the tube. The described structures can be used both for evaporator tubes and for condenser tubes.

The fin sections according to the invention are quite particularly suitable for internal structures. The inner surface of the tube is made larger here with a multiplicity of projections which are subdivided into fin sections. As a result, the heat passage resistance on the tube side is reduced to a considerable degree and the transfer of heat coefficient is increased. The projections provide additional ways for a flow of fluid inside the tube and as a result increase the turbulence of the transfer of heat medium which flows inside the tube. This measure reduces the boundary layer which is formed from the fluid near to the inner surface of the tube.

Compared to smooth surfaces, the projections provide a multiple of the proportion of the additional surface for an additional transfer of heat. Tests show that the efficiency of tubes with the fin sections of this invention which are shaped in a particular way is increased to a considerable degree.

The method-related structuring of the heat exchanger tube according to the invention can be produced by using a tool which is already described in DE 603 17 506 T2. The disclosure of this document DE 603 17 506 T2 is included fully in the present documents. As a result, the projection height and the distance can be configured variably and adapted individually with respect to the requirements, for example the viscosity of the liquid or the flow rate.

The tool which is used has a cutting edge for cutting through the fins on the inner surface of the tube in order to form fin segments and a raising edge for raising the fin segments to form the projections. In this way, the projections are formed without removing metal from the inner surface of the tube. The projections on the inner surface of the tube can be formed in the same processing step or a different processing step to the formation of the fins.

The structuring of the axially parallel or helically circumferential continuous fins which continuously run from the tube wall, with the continuously extending primary grooves between respectively adjacent fins can be produced with the method measures described in DE 101 56 374 C1. The disclosure of this document DE 101 56 374 C1 is included fully in the present documents.

The inventive solution with which the fins are subdivided into fin sections which are divided into a multiplicity of projections with a projection height causes the projections to deviate from the regulated order. This results in turn in an optimized transfer of heat with the lowest possible pressure loss, since the fluid boundary layer, which impedes good transfer of heat, is interrupted by additionally produced turbulence. An interruption as a result of the division of the projections also additionally brings about an increase in the turbulence and to an exchange of fluid over the profile of the primary fin, which also brings about an interruption of the boundary layer.

The structured region can in principle be formed here on the outer tube face or the inner tube face. However, it is preferred to arrange the fin sections according to the invention in the interior of the tube. The described structures can be used both for evaporator tubes and for condenser tubes.

A homogenous arrangement of the projections can only bring about this selective interruption of the boundary layer to a limited extent. The shapes, heights and arrangement of the spacings can be adapted and optimized by setting the cutting blades or cutting geometries and by individually adapted primary fin shapes and geometries. In order to optimize the fluid flow, the shape of the projections can be individually adapted and therefore the interruption of the boundary layer can be carried out efficiently. These optimizations for the turbulent or laminar flow form are implemented by means of different projection heights.

In one preferred refinement of the invention, the fin sections of the fins can be formed from the fins by secondary grooves running at a pitch angle β, measured with respect to the tube longitudinal axis.

In this context, the secondary grooves can run at a pitch angle of at least 10° and at most 80° compared to the inner fins. The depth of the secondary grooves can vary and be at least 20% of the original fin height of the inner fins. As a result of the introduction of the secondary grooves, the inner fins now do not have a constant cross-section any more. If the profile of the inner fins is followed, the cross-sectional shape of the inner fins changes at the points of the secondary grooves. As a result of the secondary grooves, additional eddies and axial passage locations are produced in the medium flowing on the tube side in the region near to the wall, as a result of which the transfer of heat coefficient is increased further.

If the depth of the secondary grooves is equal to the height of the original inner fins, fin sections which are spaced apart from one another on the inner tube face are produced as structural elements which are similar to truncated pyramids.

As a result of the application of secondary grooves, selective setting is possible, since the projections are formed only in the region in which the primary fin is also formed.

In contrast, it is also possible for the projections to have alternately changing cutting depths by means of a fin. With such an embodiment, the height of the individual projections can be adapted selectively and can be varied with respect to one another so that particularly in the case of laminar flow, be dipped, as a result of different fin heights, into the different boundary layers of the flow as far as the flow core and the heat be diverted to the tube wall. In this context, the cutting depth or notch depth can also extend through the entire original fin as far as the core wall.

A changing notch depth or cutting depth is also therefore equivalent for the respective deepest point of the notches to alternate and consequently for the distance from the tube wall to change. It is also equivalent to this end that the respectively deepest point of the notches—here referred to as notch base—alternates in the distance from the tube longitudinal axis over successive notches in the direction of the fins.

In this context, the notch formations which are adjacent at least around a projection vary in the notch depth by at least 10%. The variation of the notch depth can more preferably be at least 20% or even 50%.

In one advantageous embodiment of the invention, at least one projection can protrude from the main orientation along the fin profile over the primary groove. This provides the advantage that the boundary layer which is formed is interrupted in the fin intermediate space by this projection which projects into the primary groove, which brings about improved transfer of heat.

In one advantageous embodiment of the invention, the fin sections of the fins can be formed in an elongated fashion along the fin profile. In this context, the fins are subdivided into fin sections which are divided into a sufficient multiplicity of projections with a projection height. For example, a fin section comprises at least 3, preferably at least 4, projections. The fin sections can be spaced apart from one another here, as a result of which passage locations are formed for the fluid. This results in turn in an optimized transfer of heat with the lowest possible pressure loss, since the fluid boundary layer, which impedes good transfer of heat, is interrupted by additionally produced turbulence. An interruption additionally brings about an increase in turbulence here and an exchange of fluid over the profile of the primary fin, which also brings about an interruption of the boundary layer.

A plurality of projections can advantageously have a surface parallel to the tube longitudinal axis at the point farthest away from the tube wall.

In one preferred embodiment of the present invention, the projections can vary with respect to one another in terms of projection height, shape and orientation in order to adapt and vary with respect to one another the height of the individual projections selectively so that particularly in the case of laminar flow, they can dip, as a result of different fin heights, into the different boundary layers of the flow as far as the flow core and divert the heat to the tube wall.

In one particular preferred embodiment, a projection can have a tip, running to a point, at the face facing away from the tube wall. This brings about optimized condensation at the projection tip in the case of condenser tubes using two-phase fluids.

In one further advantageous refinement of the invention, a projection can have, at the face facing away from the tube wall, a curved tip whose local curvature radius is decreased starting from the tube wall as the distance increases. This has the advantage that the condensate which is produced at the tip of a projection is transported more quickly to the fin foot as a result of the convex curvature, and the transfer of heat is therefore optimized when liquefaction occurs. At the phase change, here specifically when liquefaction occurs, the focus is on the liquefaction of the vapour and the conduction away from the condensate from the tip to the fin foot. A convexly curved projection forms an ideal basis for the effective transfer of heat therefore. The basis of the projection protrudes essentially radially from the tube wall here.

In one advantageous refinement of the invention, the projections can have a different shape and/or height from the start of a tube along the tube longitudinal axis as far as the end of the tube located opposite. The advantage here is selective setting of the transfer of heat from start of the tube to end of the tube.

The tips of at least two projections can advantageously be in contact with one another or cross over one another along the fin profile, which is advantageous specifically during the phase change in the reversible operating mode, since the projections project from out of the condensate for the liquefaction and form a type of cavity for the evaporation.

In one preferred embodiment of the invention, the tips of at least two projections can be in contact with one another or cross over one another over the primary groove. This is advantageous specifically during the phase change in the reversible operating mode, since the projections project from out of the condensate for the liquefaction and form a type of cavity for the evaporation.

In one particularly preferred embodiment, at least one of the projections can be shaped in such a way that its tip is in contact with the inner tube face or the outer tube face. In particular during the phase change in the reversible operating mode this is advantageous since the projections for the liquefaction form a type of cavity for the evaporation and therefore form bubble germination points.

The projections can be advantageously formed from fins, wherein at least one of the fins differs from the others in at least one of the features of fin height, fin spacing, fin tip, fin intermediate space, fin angle of aperture and twist.

Exemplary embodiments of the invention are explained in more detail below with reference to drawings.

BRIEF DESCRIPTION OF THE DRAWINGS

In the drawings.

Mutually corresponding parts are provided in all figures with the same reference signs.

DETAILED DESCRIPTION

Figure 1:
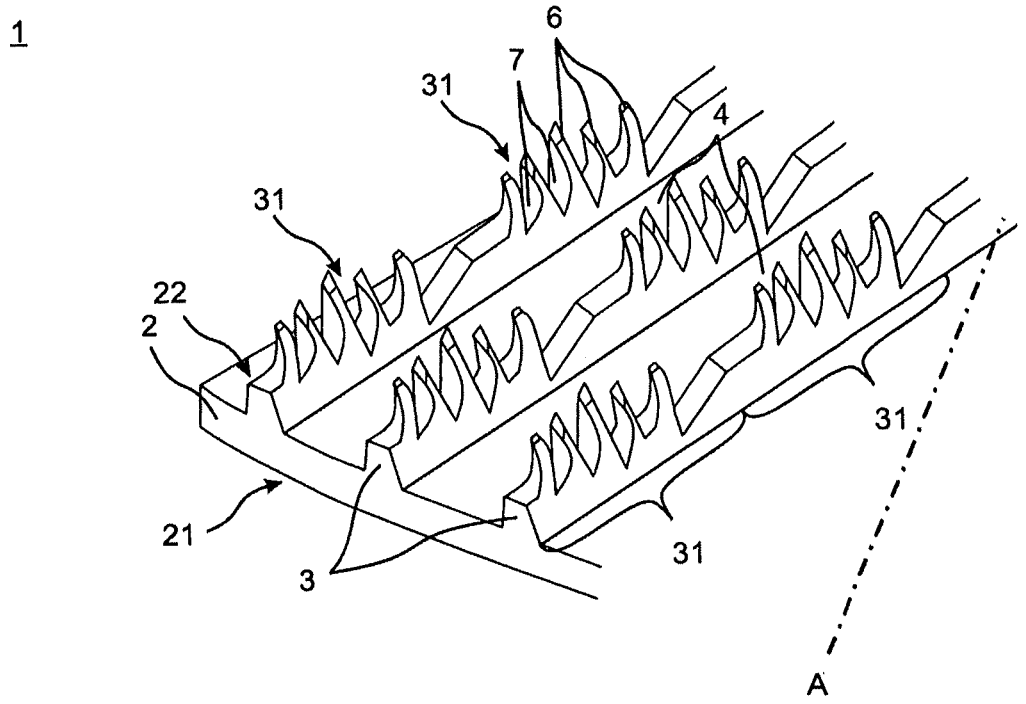
FIG. 1 shows a schematic, oblique view of a section of the tube with the inventive structure on the inner tube face.

FIG. 1 shows a schematic, oblique view of a section of the tube of the heat exchanger tube 1 with the inventive structure on the inner tube face 22. The heat exchanger tube 1 has a tube wall 2, an outer tube face 21 and an inner tube face 22. Helically circumferential continuous fins 3 are formed which continuously run from the tube wall 2 on the inner tube face 22. The tube longitudinal axis A runs at a certain angle with respect to the fins. Continuously extending primary grooves 4 are formed between respectively adjacent fins 3.

The fins 3 are subdivided along the fin profile into periodically repeating fin sections 31 which are divided into a multiplicity of projections 6. The projections 6 are formed between primary grooves 4 by making cuts into the fins 3 at a cutting depth transversely with respect to the fin profile to form fin segments and by raising the fin segments in a main orientation along the fin profile.

In FIG. 1, the fin sections 31 of the fins 3 are formed in an elongated fashion along the fin profile. In this case, one fin section 31 is delimited from the following section by a non-cut partial region of a fin 3. The original height of the primary fin 3 can also be still partially retained there.

Figure 2:
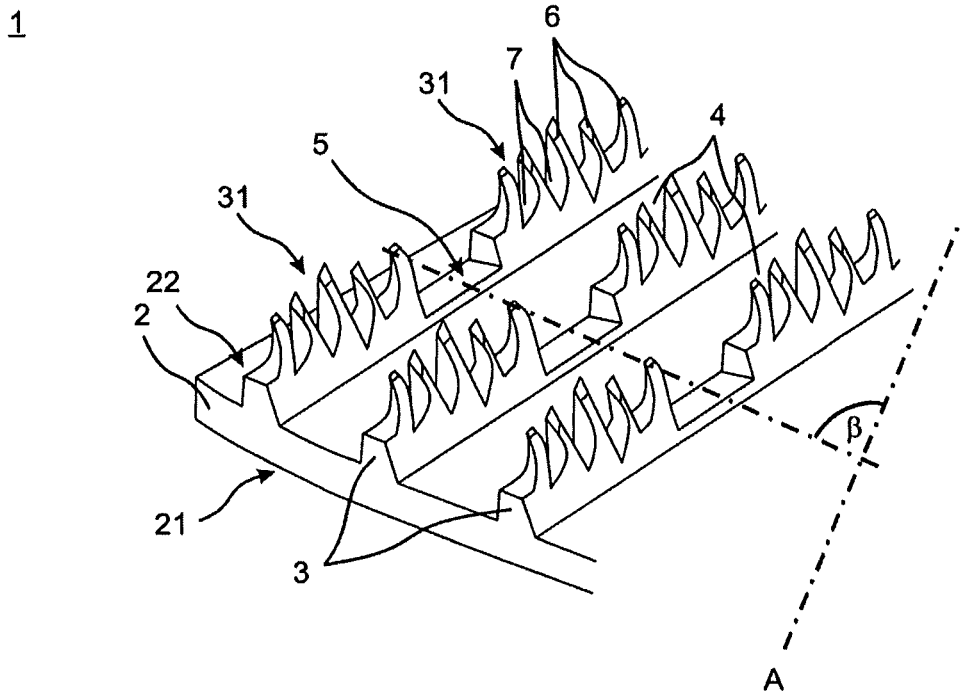
FIG. 2 shows a further schematic, oblique view of a section of the tube with the inventive internal structure with secondary groove.

FIG. 2 shows a further schematic, oblique view of a section of the tube of the heat exchanger tube 1 with the inventive structure on the inner tube face 22 having secondary grooves 5. The fins 3 are in turn subdivided along the fin profile into periodically repeating fin sections 31 which are divided into a multiplicity of projections 6.

In FIG. 2, the fin sections 31 of the fins 3 are in turn formed in an elongated fashion along the fin profile. One fin section 31 is delimited with respect to the following section by a secondary groove 5 running at a pitch angle β, measured with respect to the tube longitudinal axis A. The secondary groove 5 can have a small notch depth or, as in the examplary embodiment shown, extend to close to the primary groove with a large notch depth.

Figure 3:
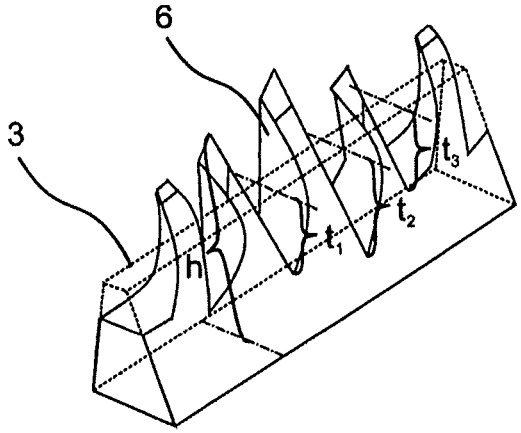
FIG. 3 shows a schematic view of a fin section with different notch depth.

FIG. 3 shows a schematic view of a fin section 31 with a different cutting depth or notch depth $t_1$, $t_2$, $t_3$. The terms cutting depth and notch depth express the same concept within the scope of the invention. The projections 6 have alternately changing cutting depths $t_1$, $t_2$, $t_3$ by means of a fin 3. The original, shaped helically circumferential continuous fin 3 is indicated by dashed lines in FIG. 3. The projections 6 are formed from said fin 3 by making cuts into the fin 3 at a cutting depth $t_1$, $t_2$, $t_3$ transversely with respect to the fin profile to form fin segments and by raising the fin segments in a main orientation along the fin profile. The different cutting depths $t_1$, $t_2$, $t_3$ are consequently measured at the notch depth of the original fin in the radial direction.

The projection height h in FIG. 2 is drawn as the dimension of a projection in the radial direction. The projection height h is then the distance starting from the tube wall as far as the point of the projection which is farthest away from the tube wall in the radial direction.

The notch depth $t_1$, $t_2$, $t_3$ is the distance measured in the radial direction starting from the original fin tips as far as the deepest point of the notch. In other words: The notch depth is the difference between the original fin height and the residual fin height remaining at the deepest point of a notch.

Figure 4:
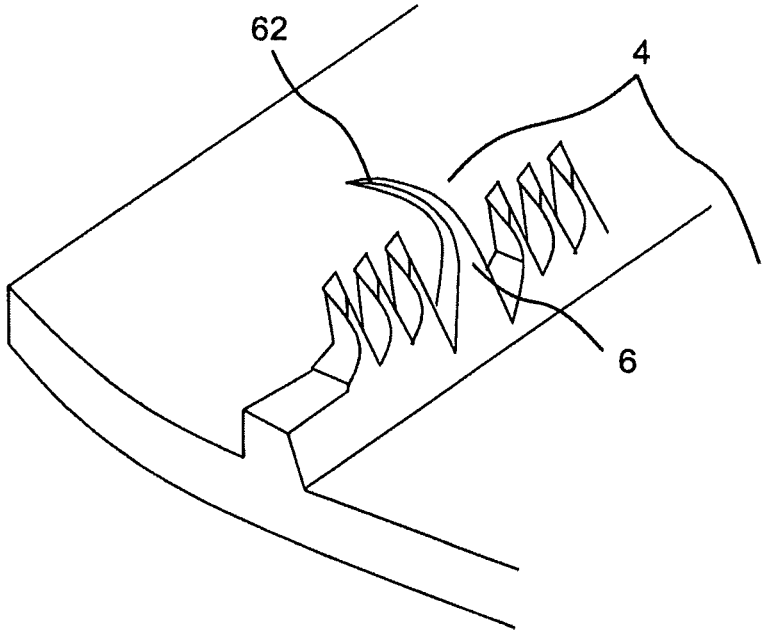
FIG. 4 shows a schematic view of a fin section with a structure element which protrudes over the primary groove.

FIG. 4 shows a schematic view of a fin section 31 with a structure element 6 which protrudes over the primary groove 4; This is a projection 6 which extends along the fin profile from the main orientation with the tip 62 over the primary groove 4. The wider the protrusion is made, the more intensive the disruption of the boundary layer of the fluid which is formed in the fin intermediate space, which brings about improved transfer of heat.

Figure 5:
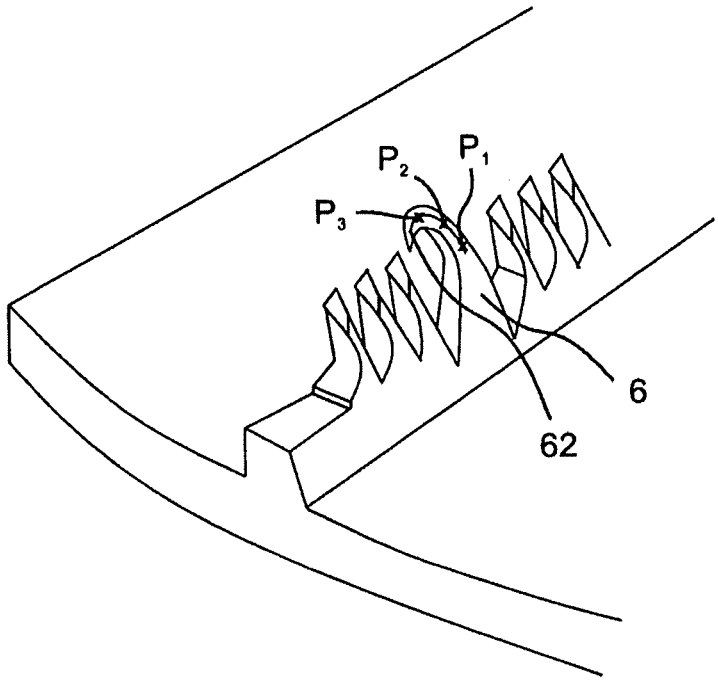
FIG. 5 shows a schematic view of a fin section with a projection which is curved at the tip in the direction of the fins.

FIG. 5 shows a schematic view of a fin section 31 with a projection 6 which is curved at the tip 62 in the direction of the fin. The projection 6 has a changing curvature profile at the curved tip 62. In this context, the local curvature radius decreases starting from the tube wall as the distance increases. In other words: The curvature radius becomes smaller along the line to the tip 62 which line is indicated by the points P1, P2, P3. This has the advantage that the condensate which is produced at the tip 62 in the case of two-phase fluids is transported more quickly to the fin foot by the increasing convex curvature. This optimizes the transfer of heat when liquefaction occurs.

Figure 6:
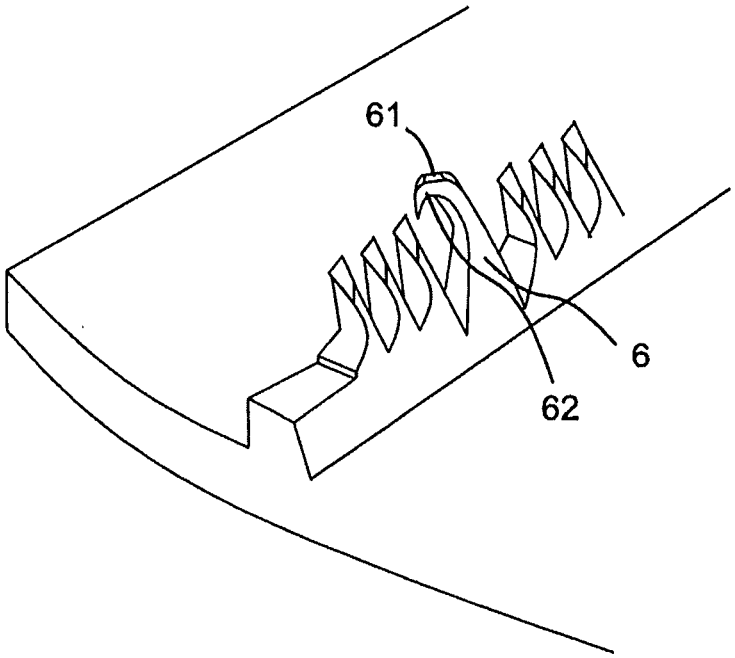
FIG. 6 shows a schematic view of a fin section with a projection having a parallel surface at the point farthest away from the tube wall.

FIG. 6 shows a schematic view of a fin section 31 with a projection 6 with a parallel surface 61 at the point which is farthest away from the tube wall, in the region of the tip 62.

Figure 7:
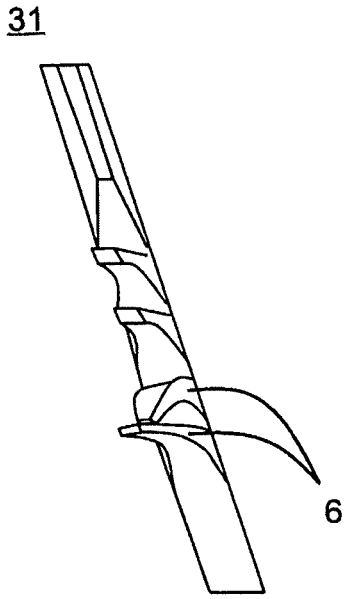
FIG. 7 shows a schematic view of a fin section with two projections which are in contact with one another along the fin profile.
Figure 8:
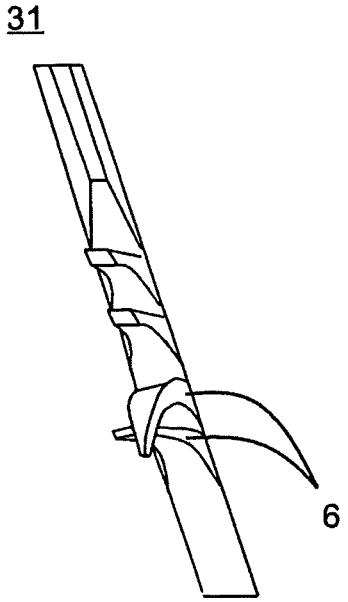
FIG. 8 shows a schematic view of a fin section with two projections which cross over one another along the fin profile.
Figure 9:
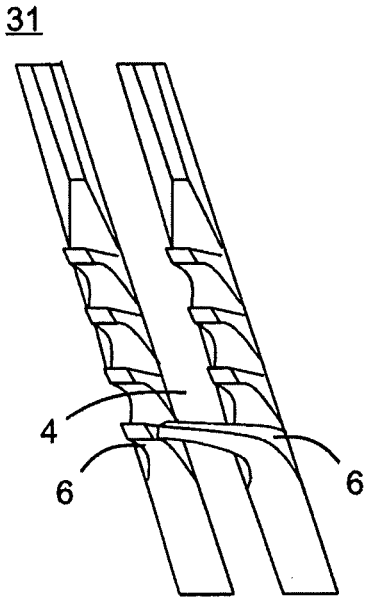
FIG. 9 shows a schematic view of a fin section with two projections which are in contact with one another over the primary groove.
Figure 10:
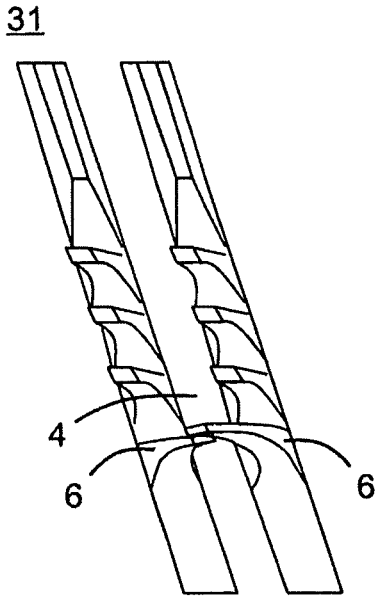
FIG. 10 shows a schematic view of a fin section with two projections which cross over one another over the primary groove.

FIG. 7 shows a schematic view of a fin section 31 with two projections 6 which are in contact with one another along the fin profile. Furthermore, FIG. 8 shows a schematic view of a fin section 31 with two projections 6 which cross over one another along the fin profile. FIG. 9 shows also a schematic view of a fin section 31 with two projections which come into contact with one another over the primary groove 4. FIG. 10 shows a schematic view of a fin section 31 with two projections 6 which cross over one another over the primary groove 4.

With the structure elements illustrated in FIGS. 7 to 10, it is advantageous, specifically in the reversible operating mode with two-phase fluids, that they form a type of cavity for the evaporation. The cavities of this particular type form the starting points for bubble nuclei of an evaporating fluid.

The invention claimed is:

1. A heat exchanger tube having a tube longitudinal axis, the heat exchanger tube comprising:

a tube wall, an outer tube face and an inner tube face;

axially parallel or helically circumferential fins formed on at least one of the outer tube face or the inner tube face, the fins being formed from the tube wall and extending continuously along tube wall;

continuously extending primary grooves formed between respectively adjacent fins; and each of the fins are subdivided into a plurality of fin sections, the fin sections of each fin periodically repeating longitudinally along the respective fin such that adjacent pairs of the fin sections are longitudinally spaced-apart from one another along the respective fin by a gap disposed therebetween, each fin section being divided into a multiplicity of projections each having a projection height, wherein the gap between adjacent fin sections of each fin has a greater longitudinal dimension than a dimension of a space defined longitudinally between adjacent projections of each fin section, and the projections are formed between the primary grooves by making cuts into the fins at a cutting depth transversely with respect to a longitudinal extent of the fin to form fin segments and by raising the fin segments in a main orientation along the longitudinal extent of the fin.

2. The heat exchanger tube as claimed in claim 1, wherein the gaps separate the fin sections of each fin and are formed in the respective fin, each gap comprising a secondary groove, the secondary grooves running at a pitch angle, wherein the pitch angle is measured with respect to the tube longitudinal axis.

3. The heat exchanger tube as claimed in claim 1, wherein the projections of the respective fin sections are formed by making cuts into the respective fin, the cuts having alternately changing cutting depths.

4. The heat exchanger tube as claimed in claim 1, wherein at least one of the projections of each fin section protrudes from the main orientation over an adjacent one of the primary grooves.

5. The heat exchanger tube as claimed in claim 1, wherein the fin sections extend in an elongated fashion along the respective fin.

6. The heat exchanger tube as claimed in claim 1, wherein some of the projections of the respective fin sections have a surface parallel to the tube longitudinal axis at a point farthest away from the tube wall.

7. The heat exchanger tube as claimed in claim 1, wherein the projections of the respective fin sections vary with respect to one another in projection height, shape and orientation.

8. The heat exchanger tube as claimed in claim 1, wherein one of the projections of the respective fin sections has a face which faces away from the tube wall and a tip running to a point at the face.

9. The heat exchanger tube as claimed in claim 1, wherein one of the projections of the respective fin sections has a face facing away from the tube wall and a curved tip on the face whose local curvature radius decreases starting from the tube wall as a distance from the tube wall increases.

10. The heat exchanger tube as claimed in claim 1, wherein the projections of the respective fin sections have at least one of a different shape or a different height from a start of the tube along the tube longitudinal axis as far as an end of the tube located opposite the start thereof.

11. The heat exchanger tube as claimed in claim 1, wherein tips of at least two of the projections of the respective fin sections are in contact with one another or cross over one another along the longitudinal extent of the respective fin.

12. The heat exchanger tube as claimed in claim 1, wherein tips of at least two of the projections of the respective fin sections are in contact with one another or cross over one another over an adjacent one of the primary grooves.

13. The heat exchanger tube as claimed in claim 1, wherein at least one of the projections of the respective fin sections has a tip which is shaped such that the tip is in contact with the at least one outer tube face or inner tube face.

14. The heat exchanger tube as claimed in claim 1, wherein the projections of the respective fin sections are formed from their respective fins, wherein at least one of the fins differs from the others in at least one of fin height, fin spacing, fin tip, fin intermediate space, fin angle of aperture or twist.

15. The heat exchanger tube as claimed in claim 1, wherein the space defined between adjacent projections of the respective fin sections comprises a cut out notch area of the respective fin, each cut out notch area having a notch depth, the notch depths of each fin section being different from one another.

16. The heat exchanger tube as claimed in claim 1, wherein each gap comprises an area of the respective fin which is free of said projections.

17. A heat exchanger tube having a longitudinal tube axis, the heat exchanger tube comprising:

a tube wall, an outer tube face and an inner tube face facing away from the outer tube face;

a plurality of elongate fins formed from the tube wall and extending continuously along at least one of the outer tube face or the inner tube face; and a plurality of elongate grooves extending continuously along the tube wall, each groove extending between two adjacent fins;

wherein each of the fins has a plurality of elongate fin sections extending therealong and being longitudinally spaced and separated from one another by respective gaps, each of the fin sections comprising a plurality of projections extending outwardly in a direction away from the at least one outer tube face or inner tube face such that each of the projections has a projection height, adjacent ones of the projections of each fin section being separated from one another by a cut out notched area of the respective fin, and the gap disposed between longitudinally adjacent fin sections has a greater longitudinal dimension than a longitudinal dimension of the cut out notched area disposed between two adjacent projections.

18. The heat exchanger tube as claimed in claim 17, wherein each cut out notched area of the respective fin sections has a notch depth, the notch depths of each fin section being different from one another.

19. The heat exchanger tube as claimed in claim 17, wherein each gap comprises an area of the respective fin which is free of said projections.

20. The heat exchanger tube as claimed in claim 17, wherein the plurality of grooves comprise primary grooves, the gaps which separate the respective fin sections of each fin are formed in the respective fin, each gap comprising a secondary groove, the secondary grooves running at a pitch angle measured with respect to the longitudinal tube axis.

* * * * *